US011357266B1

(12) United States Patent
Connors

(10) Patent No.: US 11,357,266 B1
(45) Date of Patent: Jun. 14, 2022

(54) HIGH WAISTED BIRTHING UNDERGARMENT

(71) Applicant: Gerianne Andrea Connors, Park Ridge, NJ (US)

(72) Inventor: Gerianne Andrea Connors, Park Ridge, NJ (US)

( * ) Notice: Subject to any disclaimer, the term of this patent is extended or adjusted under 35 U.S.C. 154(b) by 161 days.

(21) Appl. No.: 16/847,365

(22) Filed: Apr. 13, 2020

(51) Int. Cl.
*A41B 9/00* (2006.01)

(52) U.S. Cl.
CPC ..... *A41B 9/005* (2013.01)

(58) Field of Classification Search
CPC ..... A41C 1/10; A41B 9/005; A41B 9/004; A41B 9/007; A41B 9/008; A41D 1/21; A41D 13/1254
USPC ..... 2/406
See application file for complete search history.

(56) References Cited

U.S. PATENT DOCUMENTS 2,256,884 A * 9/1941 Boysen ..... A41B 9/14 2/404
2,313,595 A * 3/1943 Snyder ..... A41B 9/008 2/403
2,334,144 A * 11/1943 Bono ..... A41D 1/21 2/235
2,606,322 A * 8/1952 Vraciu ..... A41C 1/10 450/149
3,212,504 A * 10/1965 Sheldon ..... A41C 1/10 450/104
3,279,469 A * 10/1966 Schustack ..... A41C 1/003 450/113
3,946,579 A * 3/1976 Heinig ..... A41B 9/004 66/177
4,509,512 A * 4/1985 LeClercq ..... A41B 9/008 602/67
4,660,554 A * 4/1987 Wright ..... A41B 9/004 602/67
4,746,318 A * 5/1988 Moyer ..... A41D 1/21 450/155
5,060,315 A * 10/1991 Ewing ..... A41B 9/08 2/69
5,255,393 A * 10/1993 Brady ..... A41D 1/21 2/409
5,787,512 A * 8/1998 Knox ..... A41B 11/14 2/409
5,926,851 A * 7/1999 Kovalik ..... A41D 13/1254 2/227
5,928,059 A * 7/1999 Wicks ..... A41C 1/10 450/155
6,324,699 B1 * 12/2001 Cosmah ..... A41B 11/14 2/239
7,100,214 B1 * 9/2006 Murray ..... A41C 1/003 2/406

(Continued)

*Primary Examiner* — Heather Mangine
(74) *Attorney, Agent, or Firm* — W. Patrick Quast

(57) ABSTRACT

An undergarment to be worn by an expectant mother, throughout the second stage of labor and delivery. A cooperative interaction among a unique arc segment, waist encompassing band, abdominal segment having a perimeter section defining the abdominal opening of the garment for the wearer's pregnant belly, leg openings and posterior segment, allows for coverage by the undergarment of the perineal area of the expectant mother, between her vagina and her rectum, throughout the second stage of labor and delivery irrespective of the body positions and movements she undertakes at this stage.

19 Claims, 17 Drawing Sheets

(56) References Cited

U.S. PATENT DOCUMENTS

| | | | | |
|---|---|---|---|---|
| 8,087,098 | B2 * | 1/2012 | Kimberly | A41B 9/001 2/400 |
| 8,113,911 | B1 * | 2/2012 | Hansen | A41D 1/21 450/155 |
| 10,945,471 | B1 * | 3/2021 | Reddy | A41D 13/1254 |
| 2007/0174950 | A1 * | 8/2007 | Gidish | A41B 9/04 2/406 |
| 2012/0047633 | A1 * | 3/2012 | Greasley | A41B 9/008 2/406 |
| 2014/0053322 | A1 * | 2/2014 | Zamler | A41B 9/005 2/407 |
| 2014/0273735 | A1 * | 9/2014 | Cohen Larren | A41C 1/00 450/22 |
| 2015/0107004 | A1 * | 4/2015 | Ishiura | A41B 9/001 2/406 |
| 2016/0007658 | A1 * | 1/2016 | Kim | A41B 9/04 2/406 |
| 2017/0325526 | A1 * | 11/2017 | Barnabe | A41D 1/06 |
| 2018/0221198 | A1 * | 8/2018 | Mahon | A61F 13/72 |
| 2018/0325184 | A1 * | 11/2018 | Roberts | A41C 1/10 |
| 2019/0274374 | A1 * | 9/2019 | Marconi | A41D 1/22 |
| 2020/0093192 | A1 * | 3/2020 | Strottner | A41D 1/22 |
| 2020/0196680 | A1 * | 6/2020 | Whitt | A41B 9/023 |
| 2021/0052021 | A1 * | 2/2021 | Davis | A41D 1/065 |
| 2021/0100681 | A1 * | 4/2021 | Miles | A41D 13/1254 |

* cited by examiner

CONNECTIONS
A to G
B to H
C to I
D to BB
E to F
K to L
J to DD

SEAM BETWEEN
A/G and AA/CC ← 204
J/DD and K/L ← 206
D/BB and E/F ← 208
B/H and C/I ← 210

HIGH WAISTED BIRTHING UNDERGARMENT

RELATED APPLICATION

This application claims the benefit of U.S. Provisional Application No. 62/920,124, filed Apr. 12, 2019, which is hereby incorporated herein by reference in its entirety.

FIELD OF THE INVENTION

The present invention deals generally with clothing used by maternity patients in the hospital or birthing centers and more specifically a garment which can be worn during labor and delivery.

BACKGROUND

When women reach the pushing stage or the second stage of labor, it is important that the vaginal opening be visible and accessible to the obstetrician, mid-wife or nurse. Presently, options for coverage to this area are the hospital gown, a sheet and a pad; neither of these move or cling with the mother during necessary labor positions and often times, unexpectedly emergent, position changes.

Up until the point of active labor, the expecting mother may wear hospital underwear or even her own garments. However, during the specific and crucial stage of active labor and delivery, there is no accommodating, medical grade quality garment available.

The hospital underwear that is presently employed, does not allow for necessary visualization of the perineal or vaginal area for monitoring fetal descent. Further, existing underwear does not allow for the ease of sterile vaginal exams by the caregiver. Still further, the typical hospital underwear does not accommodate the insertion of Foley catheters; intra-uterine pressure catheters (IUPC); or, scalp electrodes. And still further, present hospital garments do not have an opening for delivery of the infant, and, typically cover the entire abdomen which needs to be continuously uncovered so that numerous important observations can be made including: shape of abdomen (oval, round, flattened or suprapubic bulge); height of fundus; presentation of fetus (done manually by palpation and visualization to determine whether a vaginal delivery continues to be possible because fetal presentation can change during labor); fetal heart rate pattern (application of ultrasound transducer or a Doppler instrument, the placement of which needs to be adjusted as fetal descent occurs. Other important observations include the descent and engagement of the infant's head (amount of descent and engagement of head is assessed manually by continually feeling how many fifths of the head are palpable above the brim of the pelvis and visually at the vaginal opening); the hardness or tenderness of the uterus which is done manually to determine if the placenta is pulling away or if the uterus is rupturing (hardness or tenderness of the uterus must be recorded continuously and reported to the doctor/midwife immediately); assessing contractions—done by placing hand on abdomen and feeling when the uterus becomes hard, and when it relaxes; and, assessing and grading of contractions which is done by placing hand on abdomen and feeling onset, peak and resting tone after contraction.

Hospitals have always had a need to contain and absorb body fluids such as blood, amniotic fluid and stool accidents during labor and delivery. The bedsheet and/or hospital blue pad or Chux pad are generally what is used presently. If the patient requires immediate position changes during labor or if her infant suddenly crowns (sustained visibility of top of the infant head), off comes the sheet and exposes the patient's bare bottom and/or vaginal area and previous "accidents" are exposed to support persons at the bedside. Many women become apologetic for what is apparent to those who may be assisting her delivery or attending loved ones. The delivering mothers will express embarrassment and exhibit anxiety; and if still pushing, will become temporarily or even completely distracted and inhibited in their efforts. Additionally, for the woman who temporarily relinquishes all modesty as a coping skill at this stage, studies have shown she may have regret or worry later on related to her perceived embarrassment and exposure. In fact, it is the experience of many caregivers associated with bed side labor and delivery that women will often decline certain beneficial birthing positions when significant others are present. It is not unheard of to have women comment that there is, "no dignity in this" or the insistence by the patient that the caregiver to "try to keep me covered". In fact, in newborn care classes or during tours of the delivery area for expecting parents, there is often a worry or concern expressed of how "accidents" will be handled during pushing. Clearly, this concern is on the mind of many expectant mothers.

Many hospital accrediting agencies such as the Joint Commission on Accreditation of Health Care Organizations (JCAHO) and MAGNET are looking at efforts to reduce caesarean births and improve infection control. The World Health Organization (WHO) is always encouraging efforts for women to have a "vaginal birth".

It is a primary object of this invention to provide a birthing garment for the expectant mother that is uniquely effective in providing ongoing coverage to sensitive areas during all stages of labor and delivery while allowing the abdomen to be continuously open during these active stages.

Yet another primary object is to provide a unique arc segment between where the two leg portions meet so that the vagina is continually visible during the second stage (or pushing stage of labor) without comprising coverage to the rectal area and buttocks. The coverage will move with the mother and offer her ongoing discretion to these areas while maintaining the ability to apply, change and assess peri-pads or hospital Chux pads that may be used. Coverage can also be maintained while allowing visual and manual access to the abdomen.

It is another object of the invention to provide continual coverage to the sensitive areas such as the buttocks and the rectum so as to eliminate embarrassment and anxiety and related inhibition at the various stages of labor and delivery.

It is still another object of the invention to provide women with the freedom to freely explore changes in position during labor that will benefit labor progression and descent of the fetus all without loss of dignity.

It is still a further object of the invention to encourage women to vary their labor position to with minimized embarrassment and anxiety barriers. Studies have shown that varying labor positions improve comfort and progression of labor and benefit the rotation and descent of the fetus.

Another most important purpose of this garment is its ability to improve efforts of infection control by containing and discretely managing bodily fluids such as amniotic fluid, blood and stool.

One further object of this invention is the benefit of "reduced anxiety" women will experience knowing prenatally that this is available to them and actually using it during their labor. When women deal with too much anxiety or worry, a cascade of hormones, namely epinephrine, can inhibit their onset, progression and quality of labor. Studies have demonstrated an adverse relationship of elevated epinephrine on muscle (the uterus is a muscle) tissue; elevated levels of epinephrine negatively affect the quality of contractions and also inhibits cervical dilation.

And yet another object of this invention is the overall improved perception women can have of the birth experience because of the improved dignity and coverage this invention offers. Studies have shown a correlation between women's perception of their labor and birth experience and the likelihood of developing or avoiding complications of post-partum depression. The more positive women view their birthing experience to be, the less likely they are to develop post-partum depression and conversely the more negative or vulnerable they view their birthing experience to have been, the more likely they are to develop complications of post-partum depression.

BRIEF DESCRIPTION OF THE DRAWINGS

An understanding of the present invention, its objects, advantages, construction and operation can be had by consideration of the following specification including accompanying drawings which are described as follows.

DESCRIPTION OF THE PREFERRED EMBODIMENT

Figure 1:
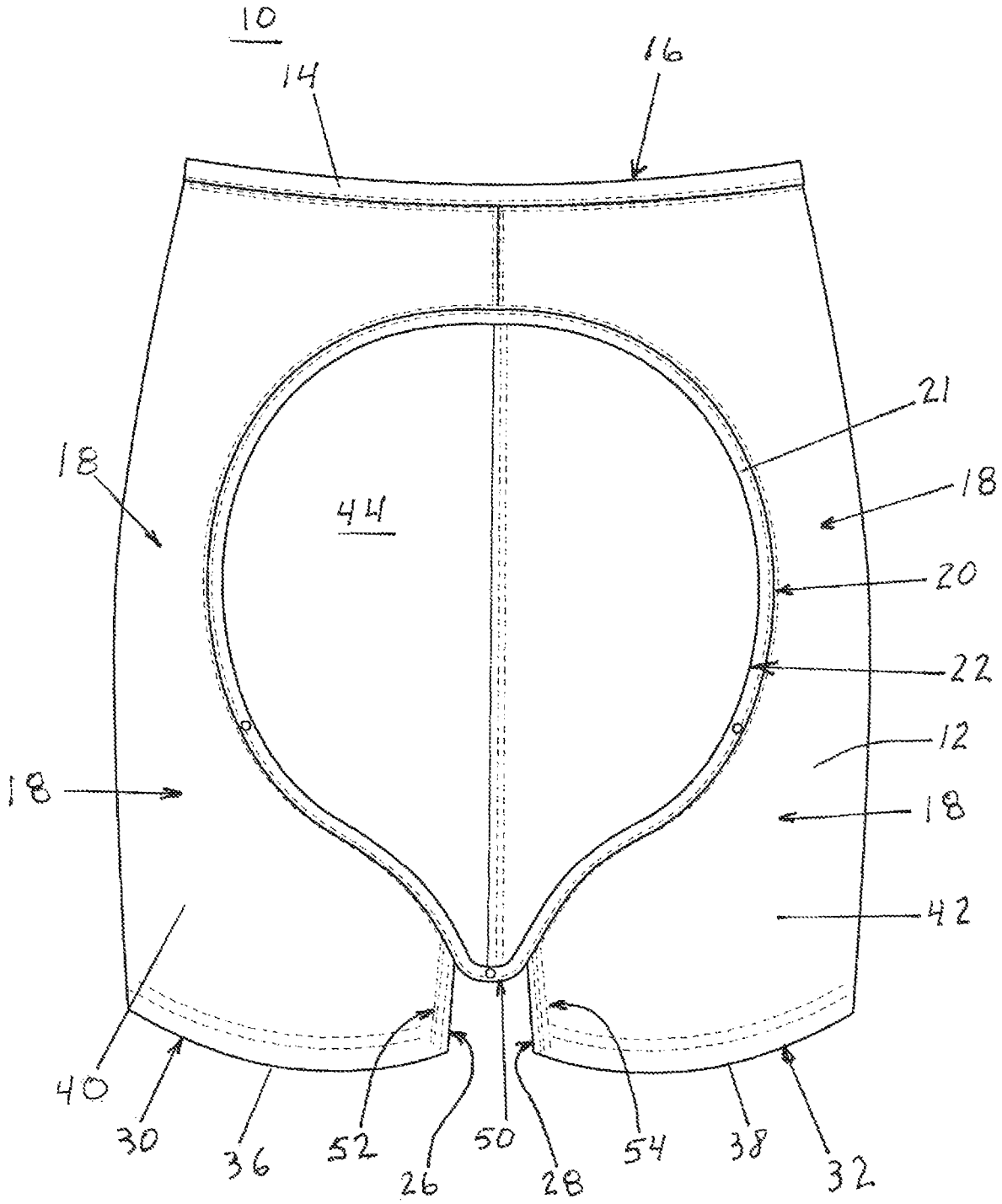
FIG. 1 is an elevation view of the undergarment as seen from the front.

Referring now to FIG. 1, the undergarment 10 is portrayed. As formed, the garment is intended to be worn by an expectant mother at the gestation period of her pregnancy approaching and through the second stage of labor including delivery.

The undergarment 10 is formed from a fabric 12 that preferably is made from a sustainable material. The presently preferred material for the fabric is 100% polyester. The fabric material provides cling and has an inherent ability to stretch, so that taken together with the unique design of the undergarment of the present invention, the expectant mother can engage in a full degree of movement, as needed, throughout the second stage of labor including delivery, achieving the objects of the invention. The polyester material can be both woven and non-woven. The latter is somewhat less expensive and would be used for a disposable version of the undergarment.

While the preferred material for the fabric is 100% polyester, it is expected that fabric material including a suitably, stretchable material such as spandex, a synthetic fiber known for its exceptional elasticity, will accomplish the purposes of the invention.

The fabric material of the undergarment provides a tighter weave than presently available in the hospital or birthing center environment. Again it is sustainable and is medical grade, bio-compatible, comfortable, breathable, and latex and allergen free.

The selected fabric material can be treated with CHITOSANTE an anti-microbial, anti-bacterial and anti-fungal solution. CHITOSANTE is a relatively new and environmentally friendly, treatment that is made from a natural biomass called Chitosan. Chitosan is made from crab and/or shrimp shells.

The CHITOSANTE solution is combined with textile fibers during the dying and/or finishing process. Chitosan binds very easily with a variety of different fibers and creates a fabric with many benefits. CHITOSANTE treatment enhances the non-allergenic and environmental friendliness of the garment. This is presently, the only anti-bacterial, bio-agent treatment in the world that is certified by the U.S. Environmental Protection Agency.

When treated, the fabric has enhanced features including: odor resistance; non-toxicity; pilling resistance; breathability; faster drying; moisture management and wicking; enhanced infection control through improved anti-bacterial and hygienic qualities. Further, the ChitoSanté treatment enhances the non-allergenic and environmental friendliness of the garment. This is presently, the only anti-bacterial, bio-agent treatment in the world that is certified by the U.S. Environmental Protection Agency.

Figure 2:
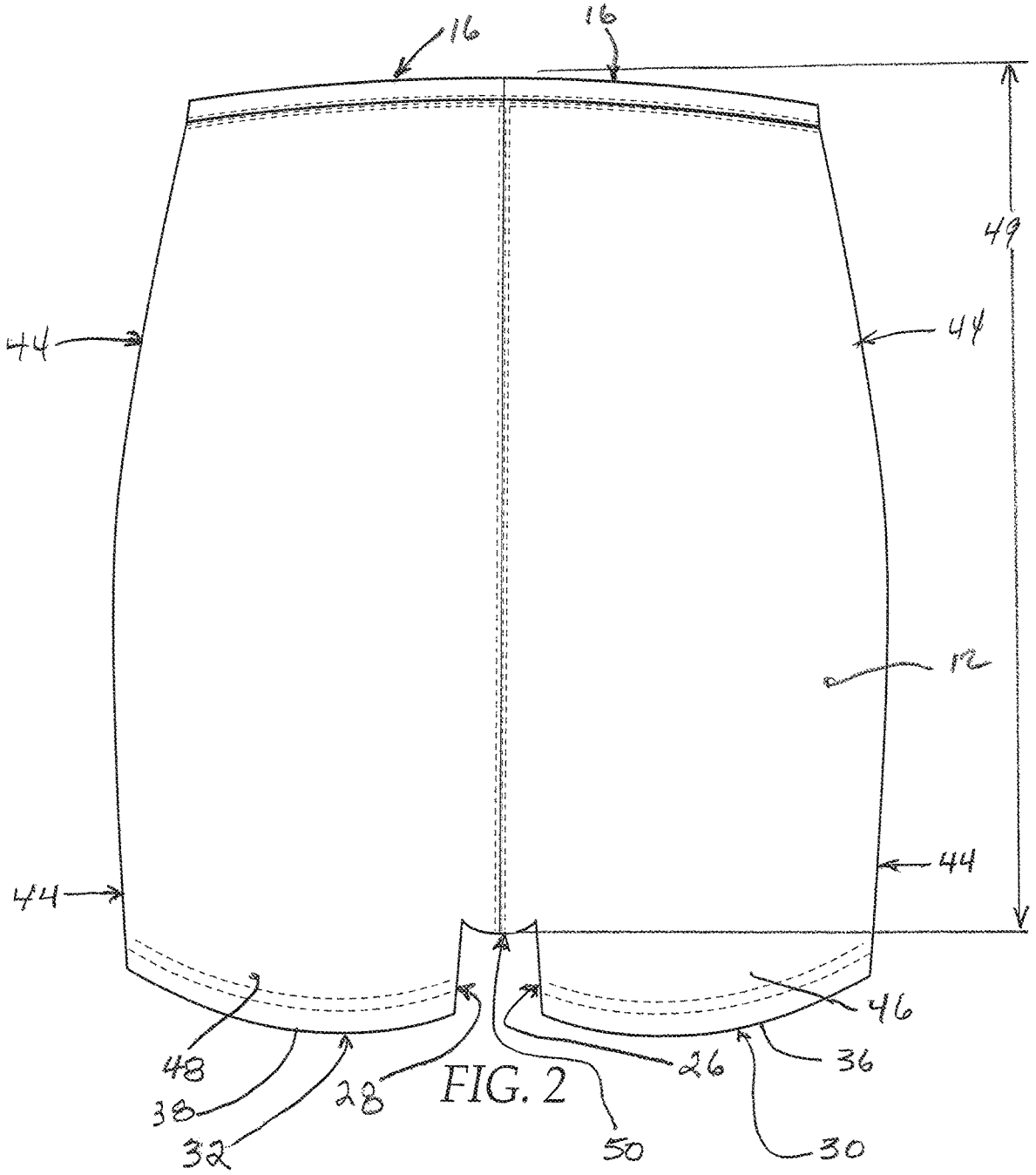
FIG. 2 is an elevation view of the undergarment as seen from the rear.

Further referring to FIGS. 1 and 2, the undergarment 10 is seen to include a waist encompassing band 14 that includes a top edge 16.

Figure 7:
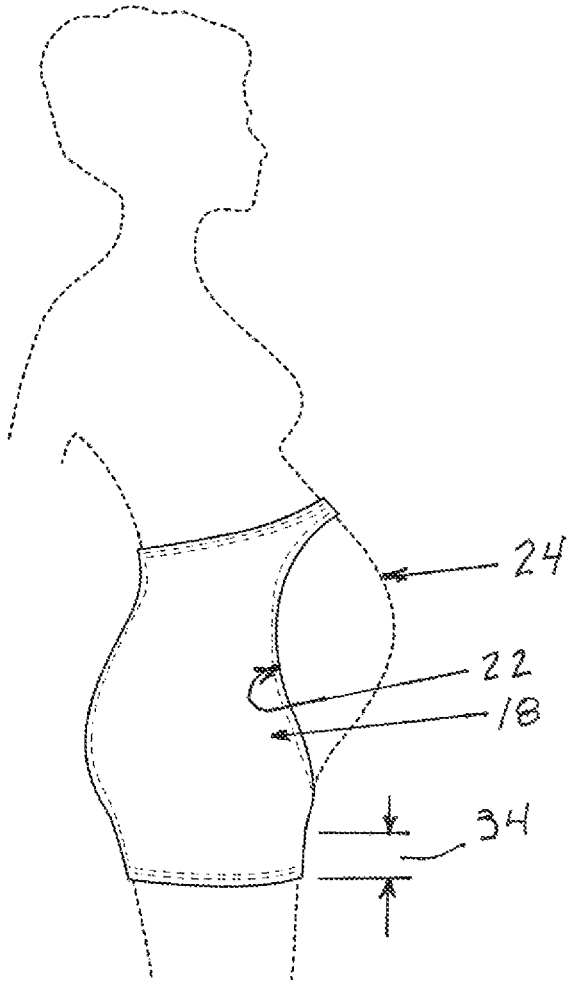
FIG. 7 is a side elevation view of the undergarment of the present invention in place on the torso of a wearer.

The formed fabric further includes an abdominal segment 18 having a perimeter section 20 encompassing an opening 22 sufficiently large to accommodate the pregnant belly 24 (see FIG. 7) of a wearer at or near full term gestation and the second stage of labor. The perimeter section includes an elastic band 21 secured thereto. The elastic band may be a silicone elastic band. The elastic band assists in preventing slippage of the undergarment on the anatomy of the wearer throughout the second stage of labor and delivery.

The formed fabric includes a pair of leg segments 26 and 28 having respective leg openings 30 and 32. The fabric is formed such that each of the leg openings 30, 32 extend down the length of a respective thigh a predetermined distance 34 (see FIG. 7). Each leg opening has a bottom edge 36 and 38. The leg segments 26 and 28 include a respective front section portion 40, 42 formed by an extension of the abdominal segment 18. Each front section portion extends down to its respective bottom edge 36 or 38 of the respective leg opening. The bottom edges 36 and 38 each include an elastic band 41, 43 (see FIG. 8) secured to the interior of the bottom edges 36 and 38 respectively. These elastic bands may be a silicone elastic band. They act to retain the leg segments on the thighs throughout labor and delivery.

Referring to FIG. 2, the stretchable fabric material is formed to include a posterior segment 44. The posterior segment 44 extends downward from the top edge 16 of the waist encompassing band. It is formed to cover a portion of the back area of the wearer, the buttocks and the rectum 45, (see FIG. 8) of the wearer.

Each of the leg segments 26 and 28 include a rear section portion 46 and 48 formed as an extension of the posterior segment. Each of the rear section portions extend down to the bottom edge 36, 38 of a respective leg opening 30, 32.

Further, the posterior segment includes a portion that extends a first predetermined length 49 (known as the back rise) from the top edge 16 of the waist encompassing band 14 down to the bottom edge of a stretchable arc segment 50 of the perimeter section 20 of the abdominal segment 18. The stretchable arc segment 50 has a second predetermined initial, arcuate length between inseams 52, 54. These are the connection points for the front section portions 40, 42 and the respective rear section portions 46 and 48 of the leg segments 26, 28. The stretch ability of the arc segment 50, due in part to the shining of the material of the posterior segment extension at this juncture, taken together with the inherent stretch ability of the fabric, complemented by the elasticity of the elastic band on the perimeter section, results in a cooperative interaction among the stretchable arc segment, the waist encompassing band, the abdominal segment, the posterior segment including importantly the back-rise length 49 and each of the leg segments. This cooperative interaction ensures that the lowest part of the posterior segment 44 will continue to cover the perineum of the wearer between her vagina and her rectum throughout the second stage of labor including delivery.

Figure 3A:
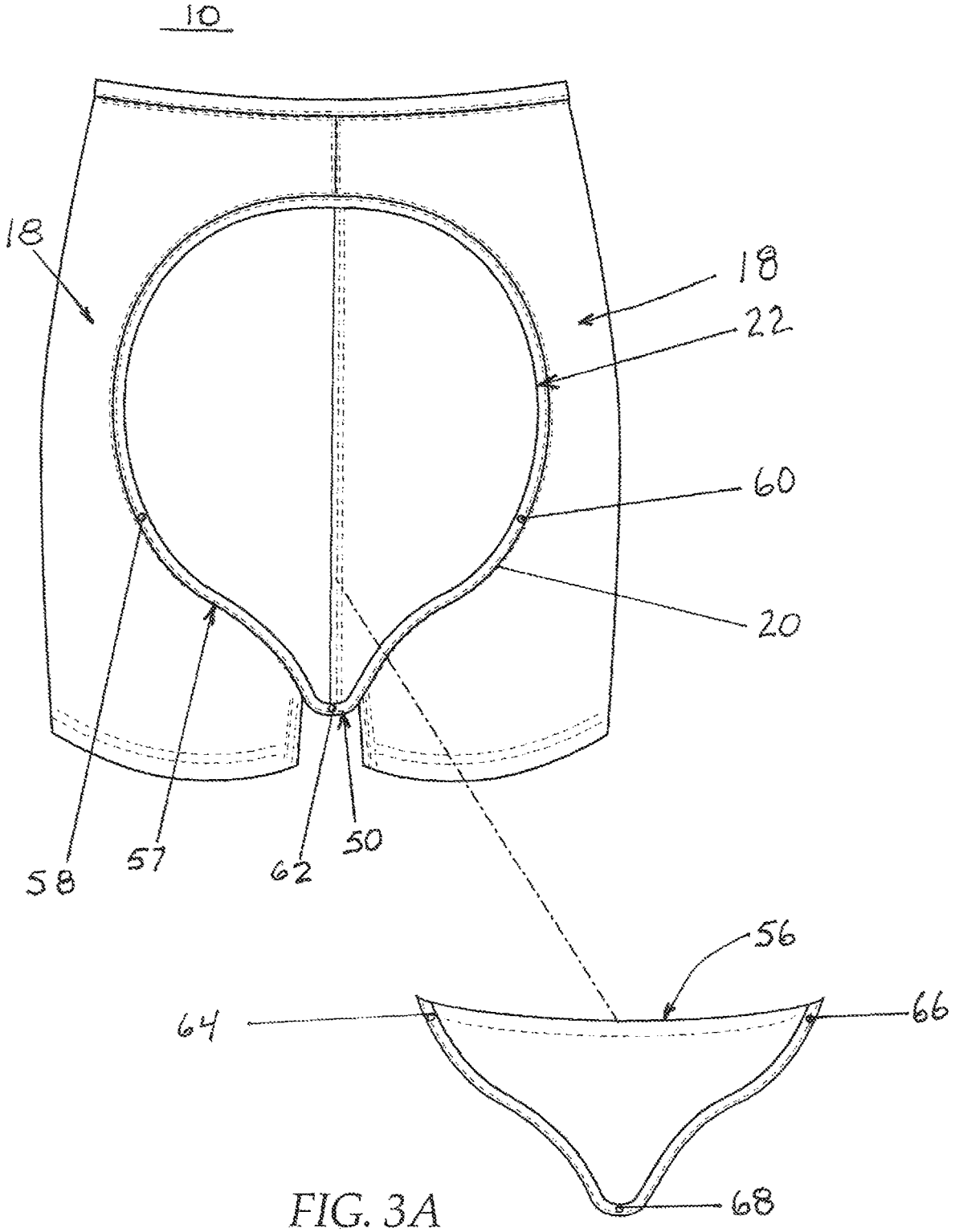
FIG. 3A is an elevation view of the undergarment of the invention depicting an aspect of the invention, a privacy panel, separate from the undergarment.
Figure 3B:
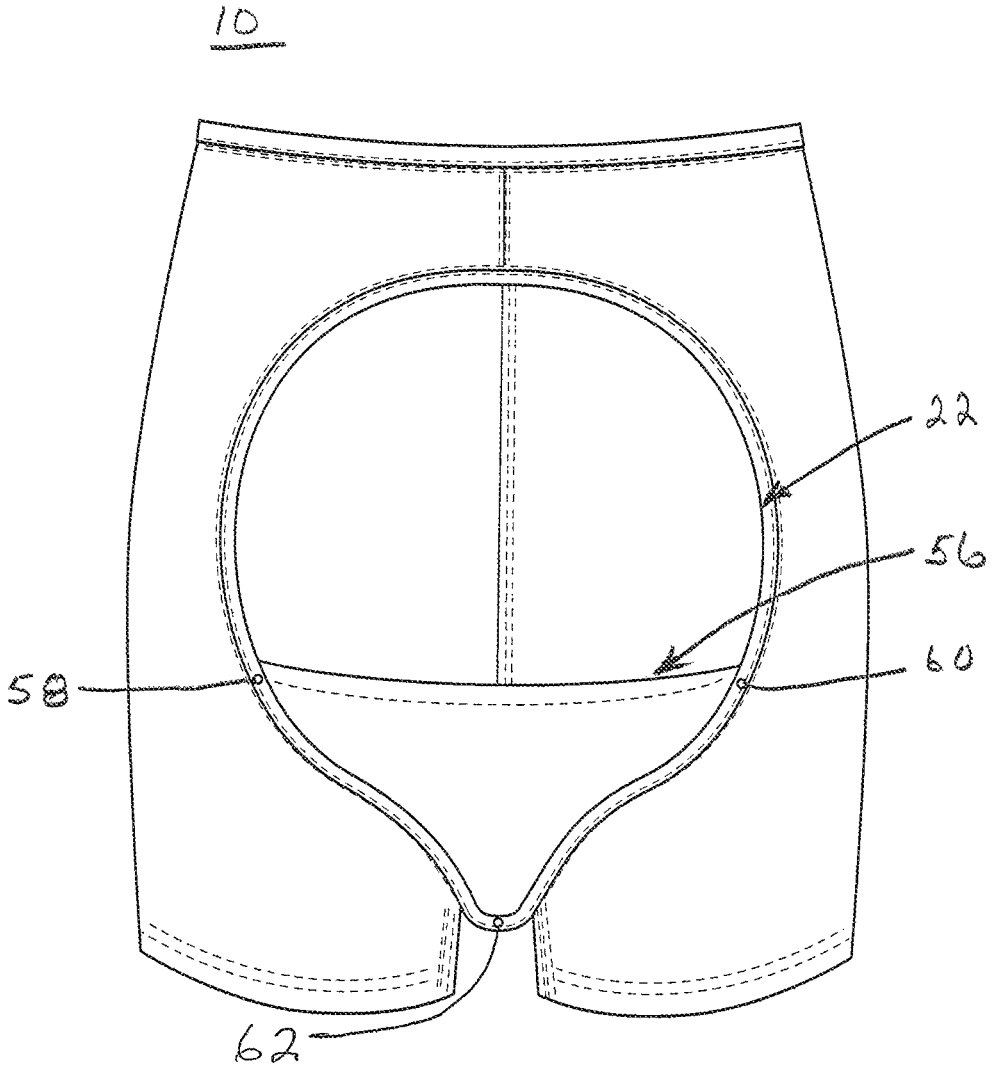
FIG. 3B is an elevation view of the undergarment of the invention showing the privacy panel of FIG. 3A in place on the undergarment.

Referring to FIGS. 3A and 3B, there is depicted a privacy panel 56 used to cover a lower area 57 of the abdomen otherwise visible through the opening 22. The embodiment depicted in these two figures, FIG. 3A and FIG. 3B, uses snaps 58, 60 and 62 positioned on the perimeter section 20 of the abdominal segment 18. The privacy panel 56 includes complementing snaps 64, 66 and 68 that mate with 58, 60 and 62 when the patch is installed.

Snaps 58 and 60 are positioned on opposite sides of the perimeter section 20. The third snap 62 is centrally located on the stretchable arc segment 50 of the perimeter section 20.

FIG. 3B shows the panel 56 of FIG. 3A in place on the undergarment. As depicted it covers the vagina area. This affords the expectant mother a needed degree of privacy early in second stage labor. As the attending person(s) need to check the status of the mother, her progress and that of the fetus one or all of the snaps can be undone opening the abdomen to accommodate these activities. If still early in the process, the panel can be re-snapped back into place. At the appropriate time, of course, the panel is removed to allow the delivery of the fetus to be closely monitored.

Figure 4A:
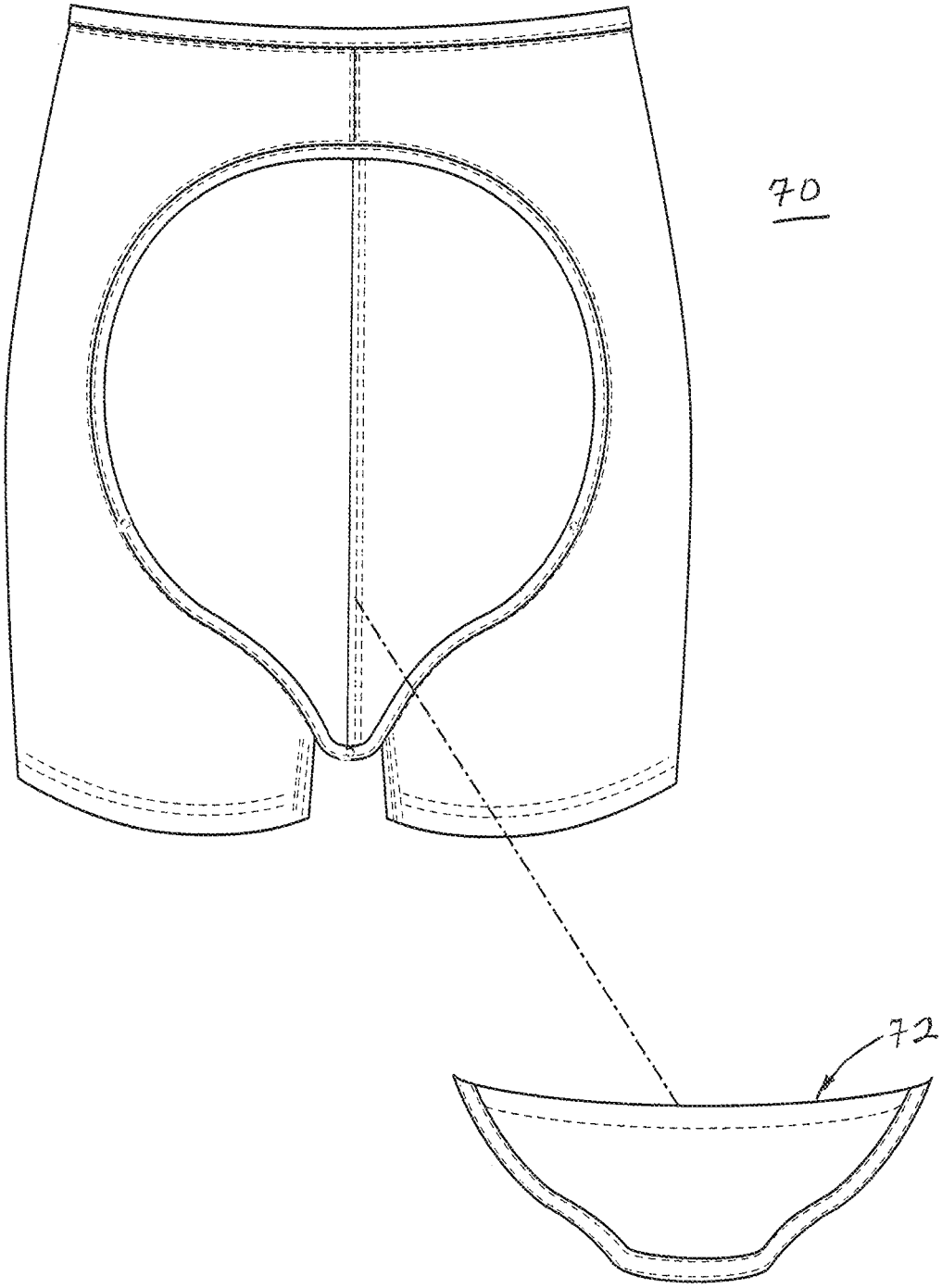
FIG. 4A is an elevation view of the undergarment of the invention showing an alternate embodiment of the privacy panel separate from the undergarment.
Figure 4B:
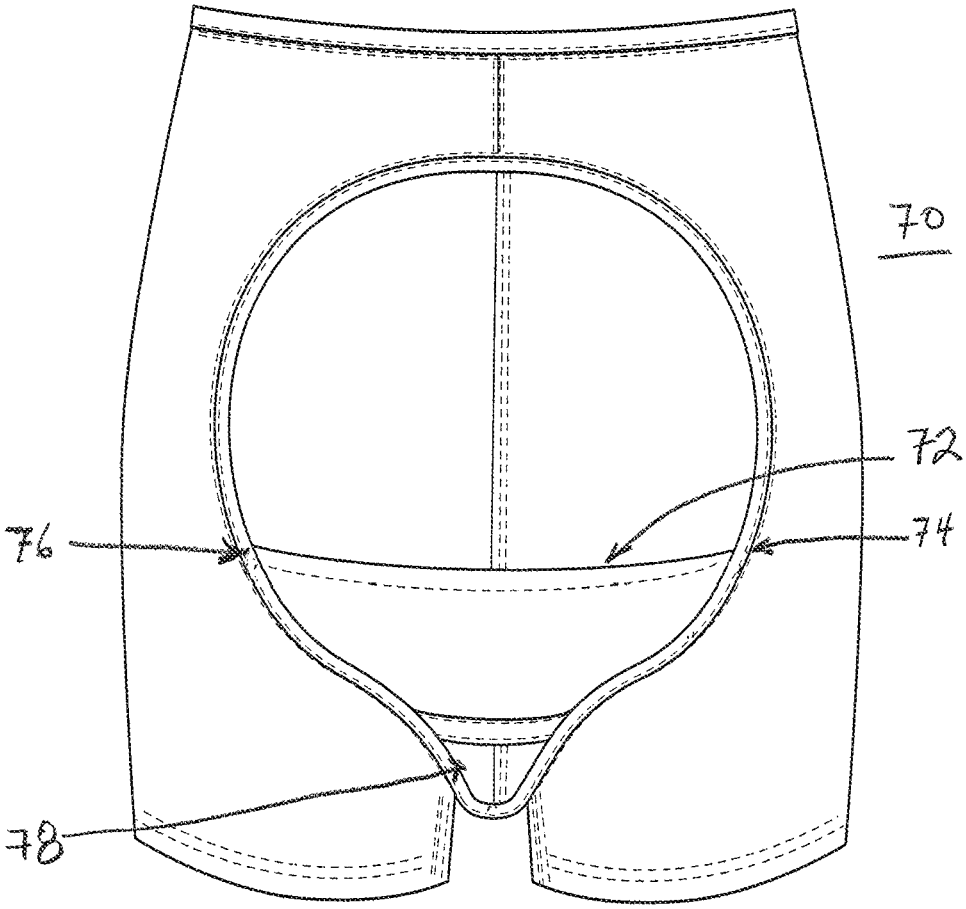
FIG. 4B is an elevation view of the undergarment of the invention showing the privacy panel alternate embodiment of FIG. 4A in place on the undergarment.

Referring to FIGS. 4A and 4B, there is depicted an embodiment of the privacy panel that is to be used in the relatively inexpensive disposable version of the undergarment 70.

In this embodiment the panel 72 is seen secured to opposite sides 74, 76, of the perimeter section 20. In this embodiment, the panel does not extend downward to the bottom of the opening. A space 78 is left which reveals the vaginal area. The panel 72 otherwise reveals enough of the abdomen at least in the early stages to allow appropriate monitoring of contractions and fetus status. When the undergarment is manufactured the panel is secured typically by stitching along the perimeter section 20 as shown. The stitching is such that the panel can be easily removed by a hand tug, if necessary, as labor progresses. Although not depicted, snaps similar to those used in the embodiment of FIG. 3A, can be used to secure panel 72 to the perimeter section; and the panel could be full size like panel 56 in FIG. 3A.

Figure 5A:
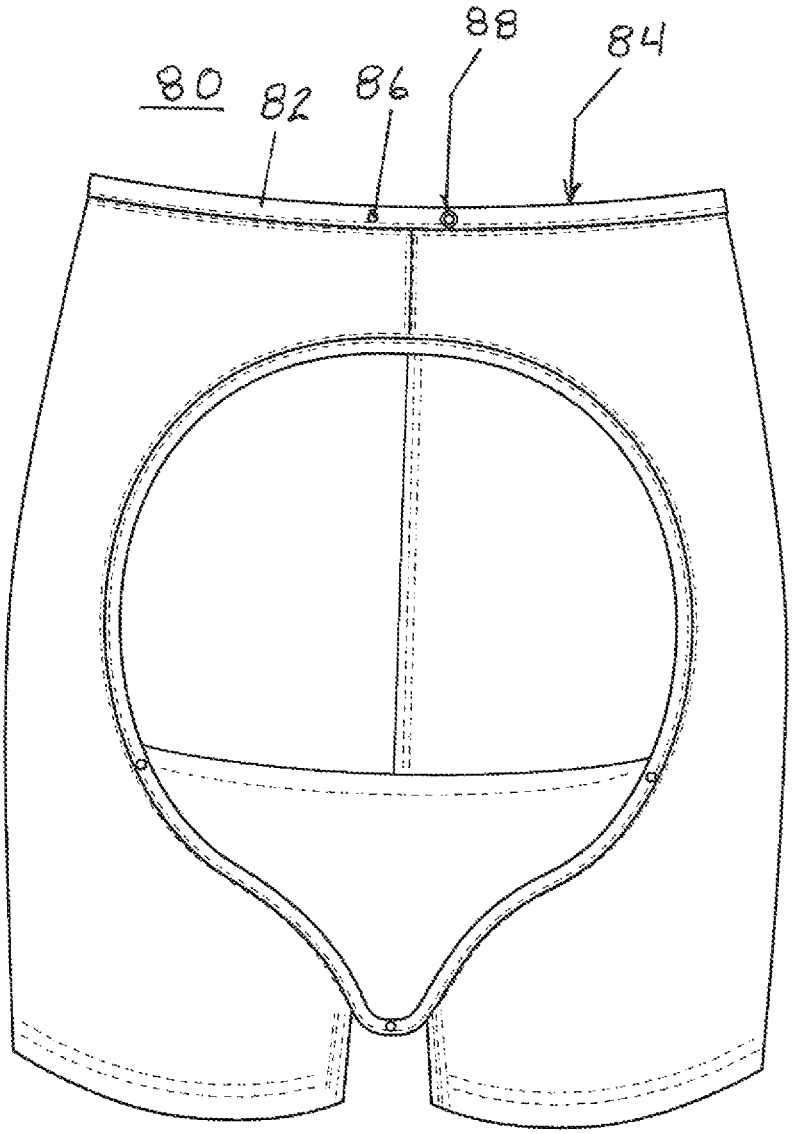
FIGS. 5A and 5B are elevation views of the undergarment depicting a waist size reduction technique of the invention.
Figure 5B:
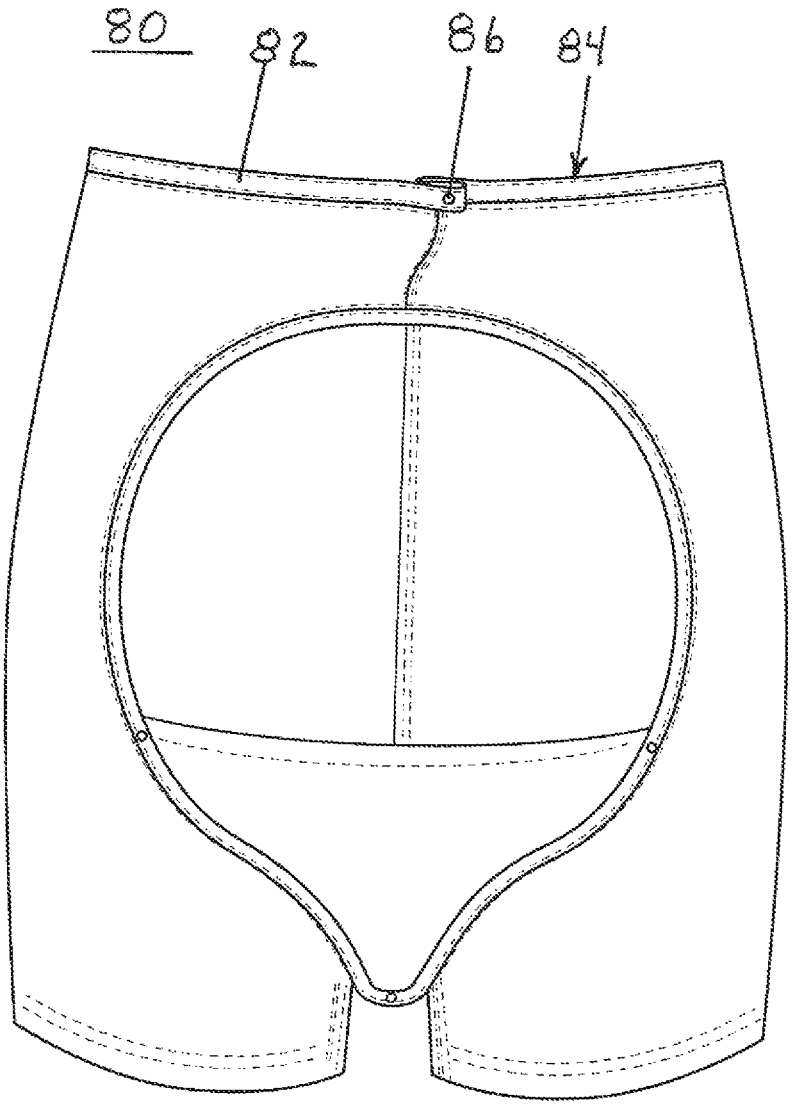

Referring now to FIGS. 5A and 5B, an adaptation of the undergarment of the present invention is depicted. One of the possible procedures to be performed on an expectant mother as she approaches delivery and the labor pains increase is an epidural. This is a procedure that injects a local anesthetic in to the epidural space around the spinal nerves in the patient's lower back (L4-L5 area). The undergarment of the present invention provides means for making at least one adjustment in the circumference length of the waist encompassing band. Here the undergarment 80 includes a waist encompassing band 82 having a top portion 84. As presented in FIG. 5A, the waist encompassing band 82 has a first circumference. Snap 86 is positioned on the top portion. A complementing mating snap 88 is also positioned at a prescribed distance from snap 86, on top portion 84.

In FIG. 5B, snap 86 and complementing mating snap 88 are secured together. This results in a reduction of the circumference of the waist encompassing band to a second circumference. Other complementing snaps, such as 88, can be positioned at prescribed distances along top portion 84 to afford further reductions in the circumference. The undergarment selected for a particularly sized wearer would provide an appropriately positioned complementing snap that would allow her to wear the undergarment with the tightness she preferred. If she were to request an epidural, the looseness afforded by releasing snap 86 from its connection to a complementing snap 88 would allow the attending person to loosen and lower the top of the undergarment and perform the procedure.

Figure 6A:
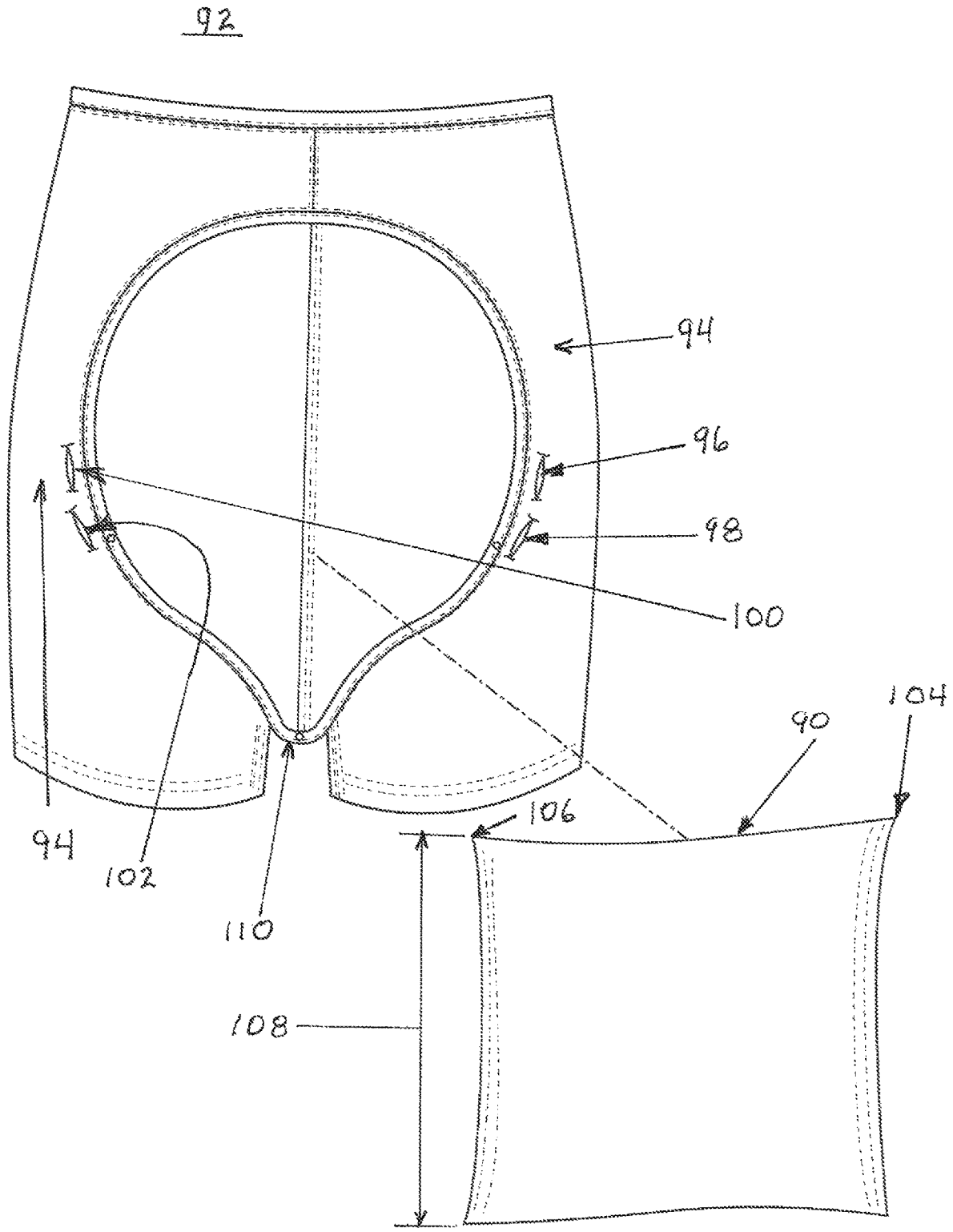
FIGS. 6A and 6B are elevation views of the undergarment depicting a way for affixing an absorbent pad to the undergarment for collection of body fluids and stool accidents throughout labor and delivery.
Figure 6B:
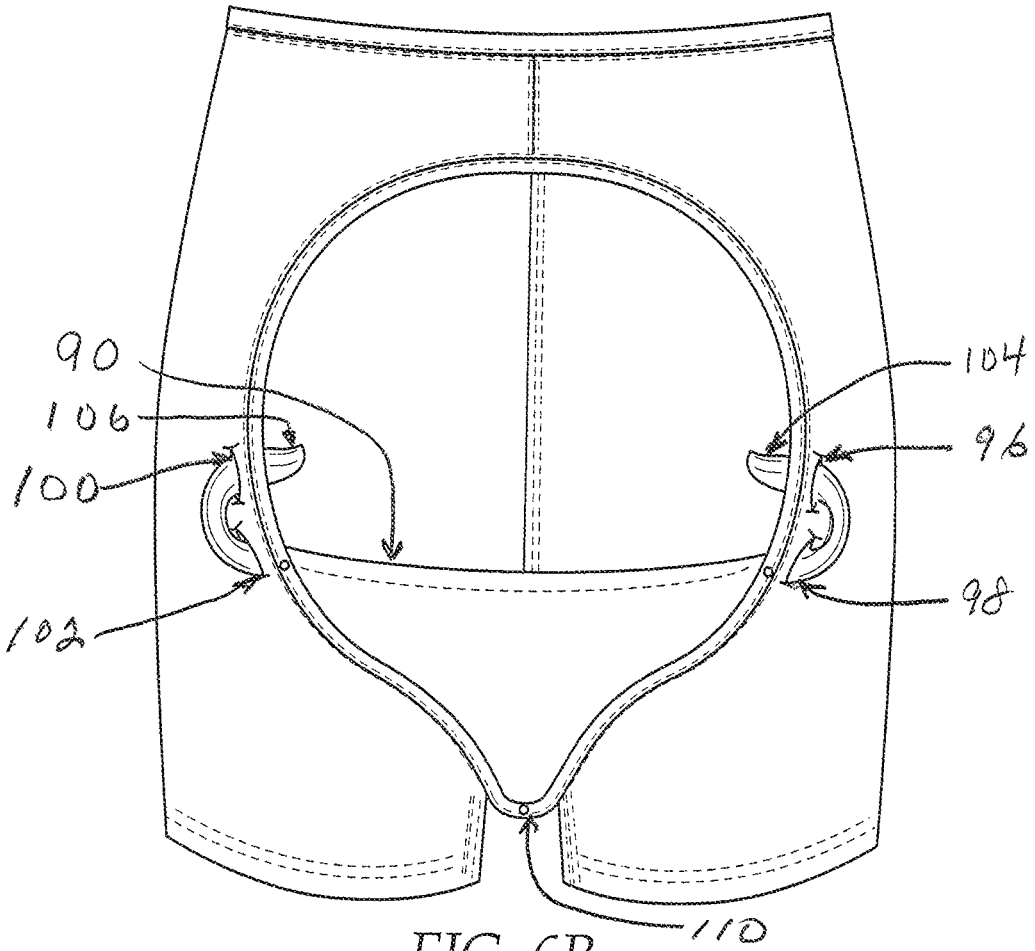

FIGS. 6A and 6B depict an adaptation of the basic undergarment of the present invention. The adaptation can be used with any of the embodiments discussed above. In FIG. 6A, an absorbent pad 90, such as a peri-pad or Chux pad, is depicted with an undergarment 92. Opposite sides 94 of the abdominal segment are each seen to include a pair of slits, 96, 98 and 100, 102, in the segment.

When it is appropriate to use the pad 90, the attending person would insert the upper corners 104 and 106 into the lower slits in each pair, 98 and 102. The upper corners are then threaded into the respective upper slits, 96 and 100, to afford a means for retaining the pad to the undergarment. The pad is of sufficient length 108 to allow the bottom end thereof to be inserted between the lower anatomy of the wearer and the stretchable arc segment 110.

Figure 8:
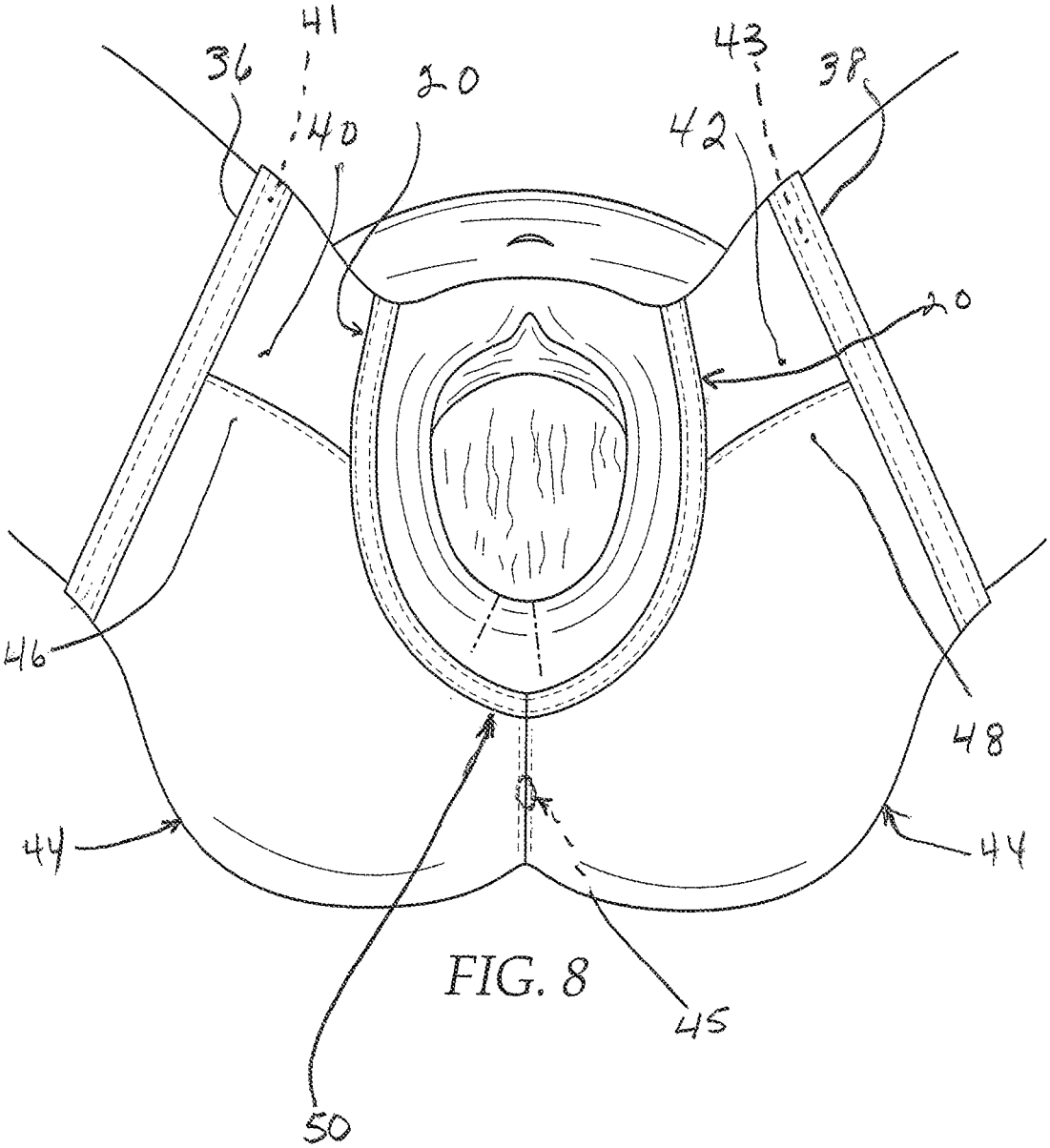
FIG. 8 is a elevation view of a lower portion of the undergarment of the present invention at the time of birth, highlighting a feature of the invention.

FIG. 8 depicts the wearer in position to deliver her child with her legs up and out. Due to the cooperative interaction discussed above the perimeter section 20, including the stretchable arc section 50 between the connected front section portions 40, 42 and rear section portions 46, 48, positions itself between the vagina and the rectum 45 so that the latter remains covered by the posterior segment 44 through delivery.

In the following discussion, FIGS. 9, 9A, 10A, 10B and 10C will be referred to collectively, and at times out of sequence.

Figure 9:
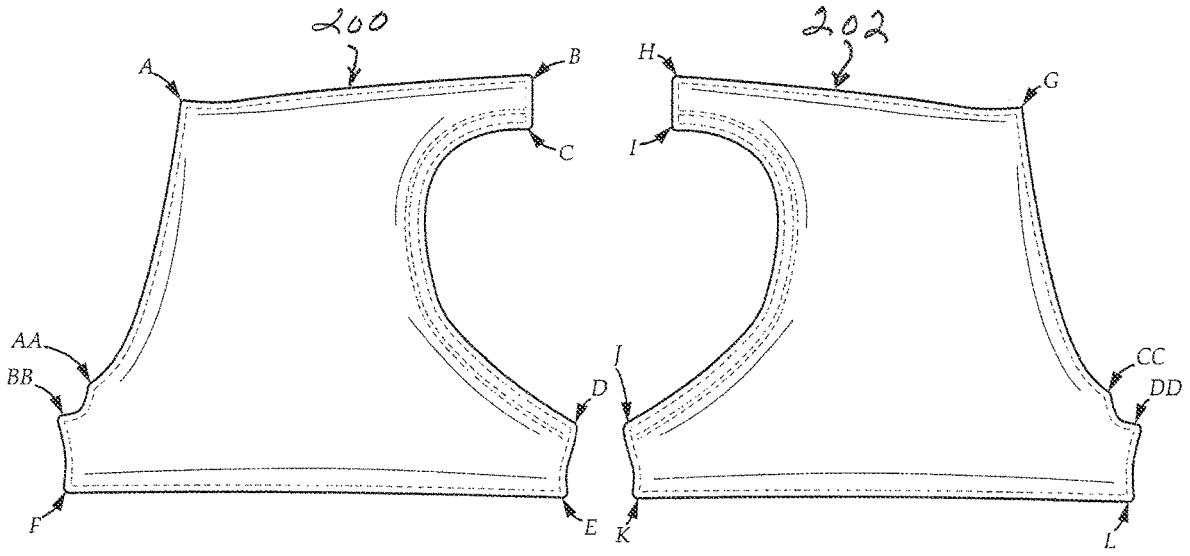
FIG. 9 is a template drawing of a pattern for the undergarment of the present invention.

FIG. 9 shows basic pattern half pieces, 200, 202. Each have respective "front" and "back" portions 200F, 202F and 200R, 202R, as referred to in FIGS. 10A and 10B (and 10C). The joinder of these pieces following the "CONNECTION" and "SEAM-BETWEEN" charts shown in the figure will result in the finished undergarment 10 which is the subject of this invention. The lengths of the various runs between connection and seam-between points will vary according to the size of the finished product, typically, small/medium, large/extra large and 1 extra large/3 extra large. (S/M, L/XL, and 1XL/3XL) respectively. For purposes of further discussion, the dimensions for the undergarment will reflect a L/XL version. Appropriate adjustments to these dimensions are to be made to accommodate the different sizes and also to accommodate changes such as the waist encompassing band adjustment feature depicted in FIGS. 5A and 5B and described in the accompanying paragraphs to those drawings.

Figure 9A:
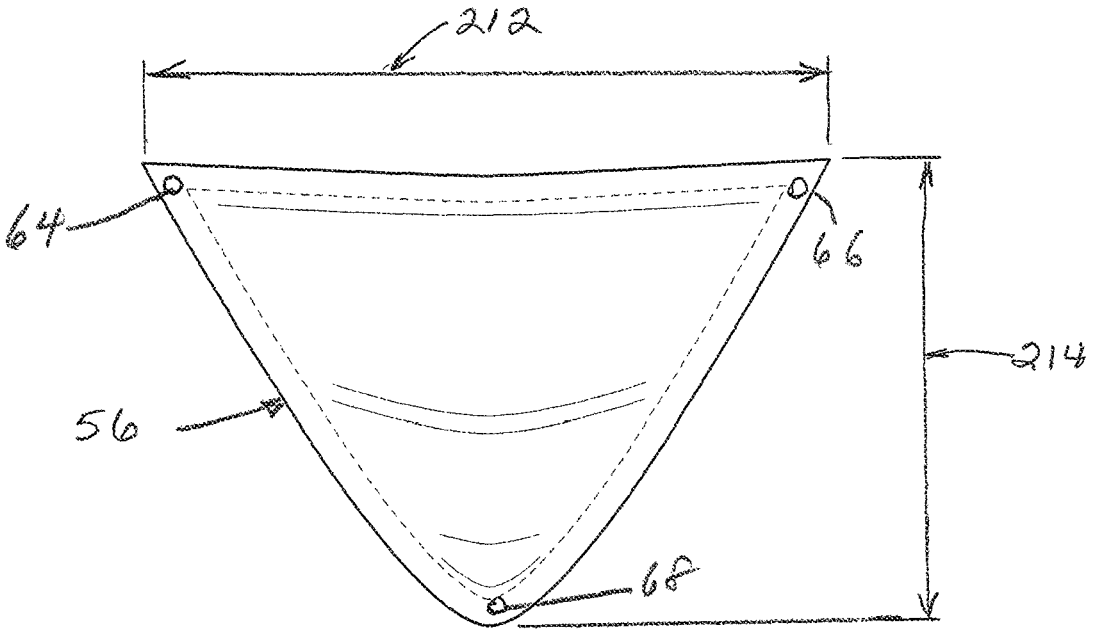
FIG. 9A is a template during of a pattern for the privacy panel element of the invention.

FIG. 9A depicts a pattern template for a privacy panel, for example 56 shown in FIG. 3A. It essentially follows the contour of the lower portion of the abdominal opening 22 between the upper snaps 58, 60 and the lower snap 62 at the bottom end. The dimensions 212 and 214 in the horizontal and vertical directions are such so as to enable the privacy panel to be positioned on the interior side of the abdominal segment and to be connected by the snaps 64, 66 and 68 to the corresponding, complementary snaps 58, 60 and 62 respectively located on the perimeter section 20 as seen in FIG. 3A. Lengths 212 and 214 for the L/XL panel, are approximately 12 inches and 7 inches respectively.

Figure 10A:
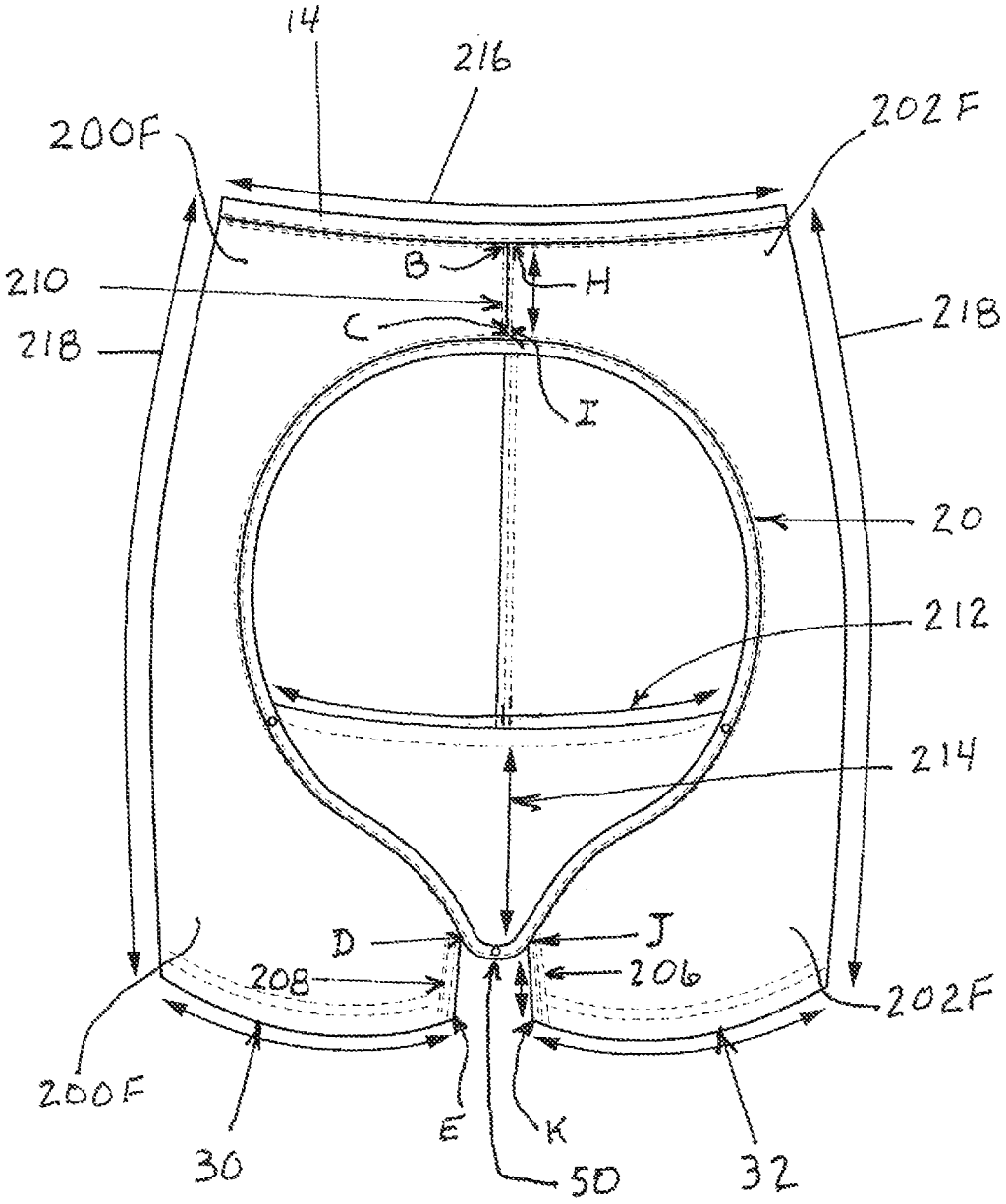
FIGS. 10A and the 10B are elevation views, front and back, of the undergarment of the invention with the privacy panel in place and lined to identify the location of various dimensions of the undergarment.
Figure 10B:
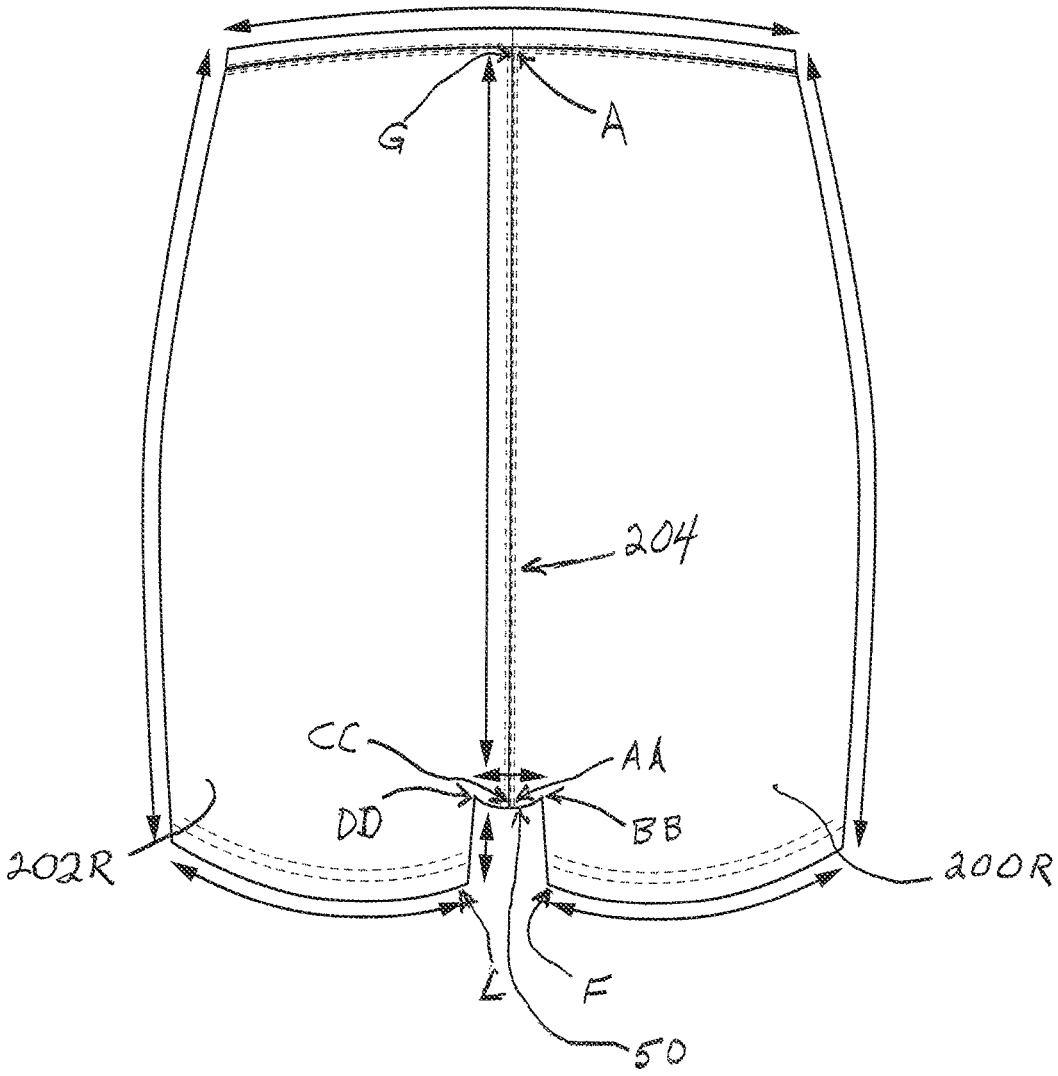
FIG. 10C is a further depiction of FIG. 4B lined to identify the location of various dimensions of this version of the undergarment.

FIG. 10A depicts the undergarment 10 from the front side. Dimension 216 signifies the circumference of the waist in a relaxed fashion. For the L/XL size garment, the waist circumstance is 35 inches. The side dimensions, 218, based on the summation of the back rise length and the inseam length on the order of approximately 17¼ inches. Referring to FIG. 10B, the back rise seam, 204 is 15 inches. The inseam lengths, 206 and 208 are each 2¼ inches. The sum of the back rise of 15 inches and the inseam length (J/DD to K/L; and D/BB to E/F) of 2¼ inches provides the approximate length of dimension 218, 17¼ inches. The length of the perimeter section 20 encompassing the opening 22 is 41 inches. The height of the waist encompassing band 14, between the connecting points B/H and C/I (from FIG. 9) are approximately 2 inches with an additional ⅝ of an inch for the waist band height. The circumference of each leg opening 30, 32 (length of E to F and K to L in FIG. 9) is approximately 23 inches. The approximate at—rest arc length of the stretchable arc segment 50 (segments AA to BB plus CC to DD in FIG. 10B) is 2.00 inches.

Figure 10C:
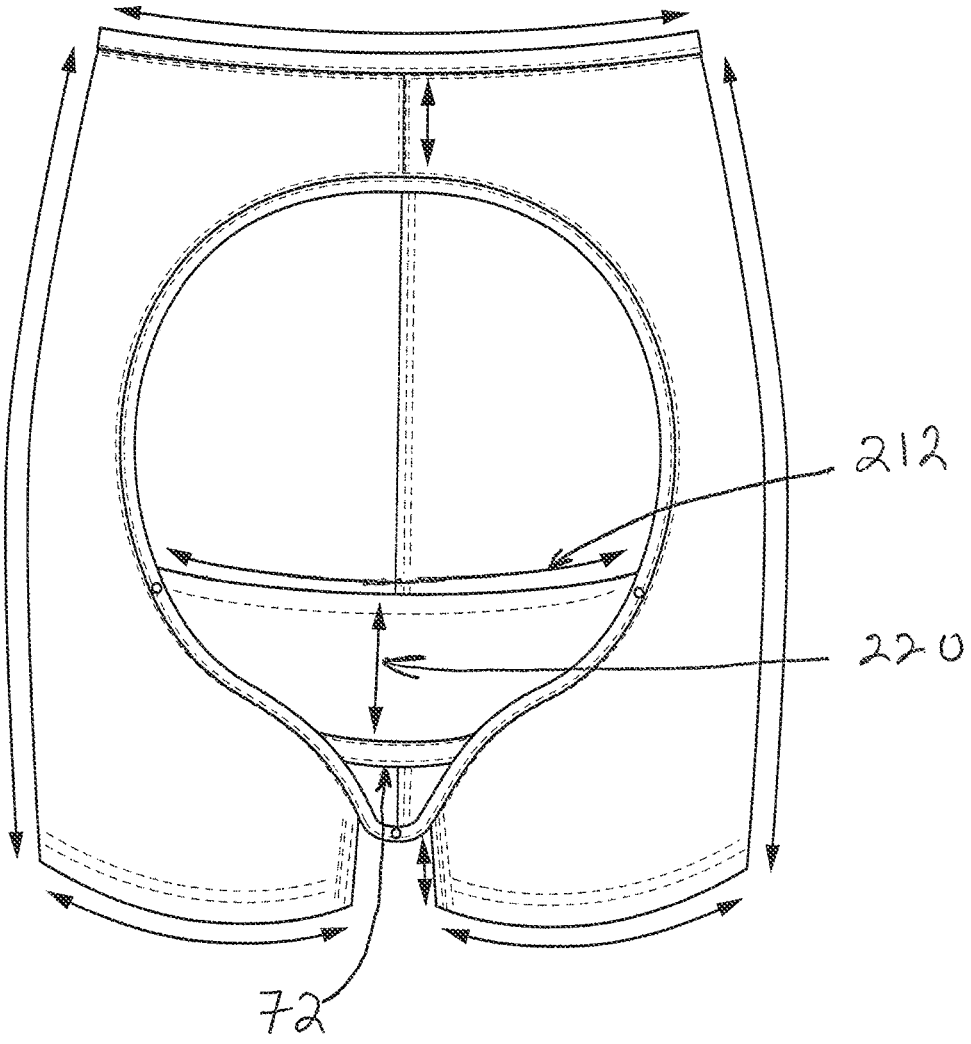

In the embodiment of FIG. 10C, the panel 72 (see FIGS. 4A and 4B) has a similar length 212 to panel 56 (see FIG. 3A) of approximately 12 inches. The height 220 of the panel 72 is approximately 3.0 inches.

While the present invention has been described with particular reference to specific examples, it will be apparent to those skilled in the art that various changes and modifications within the scope of the invention may be made thereto.

What is claimed is:

1. An undergarment to be worn by a wearer during a second stage of labor, the undergarment comprising:

(a) a fabric made of 100% polyester material forming the undergarment;

(b) said fabric formed to include a waist encompassing band having a top edge;

(c) said fabric further formed to have an abdominal segment including a perimeter section encompassing an opening configured to be sufficiently large to encompass the wearer's pregnant belly at or near full term gestation and the second stage of labor;

(d) said fabric further formed to include a pair of leg segments having respective leg openings, said fabric formed such that each said leg segment is configured to extend down a length of a respective thigh a predetermined distance below a crotch area of the wearer, each leg opening having a bottom edge; each of said leg segments including a front section portion formed by an extension of said abdominal segment, each said front section portion extending down to the bottom edge of the respective leg opening; and, (e) said fabric formed to include a posterior segment, said posterior segment extending downward from the top edge of said waist encompassing band, said posterior segment formed to cover a back area, and a buttocks and rectum area of the wearer; each of said leg segments including a rear section portion formed by an extension of said posterior segment, each of said rear section portions extending down to the bottom edge of each of the respective leg openings, said posterior segment further including a portion extending a first predetermined length from the top edge of said waist encompassing band to a stretchable arc segment of the perimeter section of the abdominal segment disposed in-between said leg segments, said stretchable arc segment of a second predetermined length, whereby due at least in part to a stretching of the arc segment and the stretch ability of the fabric used in forming of the undergarment, a cooperative interaction among said stretchable arc segment of the second predetermined length, said waist encompassing band, said abdominal segment, said posterior segment including the portion having the first predetermined length, and said each leg segment is achieved whereby the stretchable arc segment is configured to be maintained in a perineal area of the wearer between her vagina and her rectum throughout the second stage of labor and delivery.

2. The undergarment claimed in claim 1 wherein at least the perimeter section encompassing said abdominal opening includes an elastic band secured thereto whereby the perimeter section of the abdominal opening is configured to be retained in place about the wearer's abdomen irrespective of the wearer's movements during labor and delivery, and wherein the bottom edge of each respective leg opening includes an elastic band secured thereto.

3. The undergarment claimed in claim 2 wherein at least the elastic band secured to the perimeter section is a silicone elastic band.

4. The undergarment claimed in claim 2, further comprising coverage means connected to the abdominal segment for providing privacy to a lower area of the abdomen otherwise visible through the opening in the abdominal segment.

5. The undergarment claimed in claim 4 wherein the coverage means is connected between opposite sides of the perimeter section encompassing the abdominal opening and the coverage means extends down from the opposite sides of the perimeter section and connects to the stretchable arc segment.

6. The undergarment claimed in claim 2 further including means for securing an absorbent pad between opposite sides of the abdominal segment so as to span the abdominal opening from a first opposite side to a second opposite side, said absorbent pad extending down from the first and second opposite sides of the abdominal segment, said absorbent pad of sufficient length to allow a bottom end thereof to be inserted between a lower anatomy area of the wearer and said stretchable arc segment.

7. The under-garment claimed in claim 1 wherein an opening formed by said waist encompassing band has a circumference, said waist encompassing band including means for making at least one adjustment to the length of the circumference from a first dimension to a second dimension, said at least one adjustment sufficient to loosen the waist encompassing band enough to allow an attending person to perform an epidural procedure in a lower back area of the wearer.

8. The undergarment claimed in claim 1 wherein the fabric is non-woven.

9. The undergarment claimed in claim 8 wherein at least the perimeter section encompassing said abdominal opening includes an elastic band secured thereto whereby the perimeter section of the abdominal opening is retained in place about the wearer's abdomen irrespective of the wearer's movements during labor and delivery, and wherein the bottom edge of each respective leg opening includes an elastic band secured thereto.

10. The undergarment claimed in claim 9 wherein at least the elastic band secured to the perimeter section is a silicone elastic band.

11. The undergarment claimed in claim 9, further comprising coverage means connected to the abdominal segment for providing privacy to a lower area of the abdomen otherwise visible through the opening in the abdominal segment.

12. The undergarment claimed in claim 11 wherein the coverage means is connected between opposite sides of the perimeter section encompassing the abdominal opening and the coverage means extends down from the opposite sides of the perimeter section and connects to the stretchable arc segment.

13. The under-garment claimed in claim 8 wherein an opening formed by said waist encompassing band has a circumference, said waist encompassing band including means for making at least one adjustment to the length of the circumference from a first dimension to a second dimension, said at least one adjustment sufficient to loosen the waist encompassing band enough to allow an attending person to perform an epidural procedure in a lower back area of the wearer.

14. The undergarment claimed in claim 8 wherein the non-woven fabric used to form the undergarment is made from processing a biomass from crab or shrimp shells with polyester fibers.

15. The undergarment claimed in claim 1 wherein the fabric used to form the undergarment is made from processing a biomass from crab or shrimp shells with polyester fibers.

16. An undergarment to be worn by a wearer during a second stage of labor, the undergarment comprising:

(a) a fabric made of material including a stretchable material including spandex material forming the undergarment;

(b) said fabric formed to include a waist encompassing band having a top edge;

(c) said fabric further formed to have an abdominal segment including a perimeter section encompassing an opening configured to be sufficiently large to encompass the wearer's pregnant belly at or near full term gestation and the second stage of labor;

(d) said fabric further formed to include a pair of leg segments having respective leg openings, said fabric formed such that each said leg segment is configured to extend down a length of a respective thigh a predetermined distance below a crotch area of the wearer, each leg opening having a bottom edge;

each of said leg segments including a front section portion formed by an extension of said abdominal segment, each said front section portion extending down to the bottom edge of the respective leg opening; and, (e) said fabric formed to include a posterior segment, said posterior segment extending downward from the top edge of said waist encompassing band, said posterior segment formed to cover a back area, and a buttocks and rectum area of the wearer; each of said leg segments including a rear section portion formed by an extension of said posterior segment, each of said rear section portions extending down to the bottom edge of each of the respective leg openings, said posterior segment further including a portion extending a first predetermined length from the top edge of said waist encompassing band to a stretchable arc segment of the perimeter section of the abdominal segment disposed in-between said leg segments, said stretchable arc segment of a second predetermined length, whereby due at least in part to a stretching of the arc segment and the stretch ability of the fabric used in forming of the undergarment, a cooperative interaction among said stretchable arc segment of the second predetermined length, said waist encompassing band, said abdominal segment, said posterior segment including the portion having the first predetermined length, and said each leg segment is achieved whereby the stretchable arc segment is configured to be maintained in a perineal area of the wearer between her vagina and her rectum throughout the second stage of labor and delivery.

17. The undergarment claimed in claim 16 wherein the fabric used to form the undergarment is made from processing a biomass from crab or shrimp shells with fabric fibers.

18. The undergarment claimed in claim 17 wherein the fabric material is non-woven.

19. The undergarment claimed in claim 16 wherein the fabric material is non-woven.

* * * * *